US006478403B1

(12) United States Patent
Giles et al.

(10) Patent No.: US 6,478,403 B1
(45) Date of Patent: Nov. 12, 2002

(54) PRINT HEAD TRANSPORT MECHANISM

(75) Inventors: Christopher Michael Giles, Haverhill; Walter Herbert Henson, Hornchurch, both of (GB)

(73) Assignee: Neopost Limited, Romford (GB)

( * ) Notice: Subject to any disclaimer, the term of this patent is extended or adjusted under 35 U.S.C. 154(b) by 0 days.

(21) Appl. No.: 09/375,902

(22) Filed: Aug. 17, 1999

(30) Foreign Application Priority Data

Aug. 18, 1998 (GB) ..... 9818025

(51) Int. Cl.[7] ..... B41J 23/00
(52) U.S. Cl. ..... 347/37; 400/283
(58) Field of Search ..... 347/37, 39; 400/283, 400/291, 344, 351, 355

(56) References Cited

U.S. PATENT DOCUMENTS

| | | | | |
|---|---|---|---|---|
| 4,657,415 A | * | 4/1987 | Kikuchi et al. | 400/59 |
| 4,774,529 A | * | 9/1988 | Paranjpe et al. | 347/43 |
| 5,037,215 A | * | 8/1991 | Crick | 400/124.01 |
| 5,762,428 A | | 6/1998 | Cordery et al. | |
| 6,089,696 A | * | 7/2000 | Lubinsky | 347/40 |

FOREIGN PATENT DOCUMENTS

| | | | |
|---|---|---|---|
| DE | 3213646 | 4/1986 | G06H/15/10 |
| EP | 0748693 | 6/1996 | B41J/2/21 |
| EP | 0827839 | 7/1997 | B41J/2/51 |
| GB | 2319991 | 12/1997 | B41J/25/308 |
| JP | 9-254489 | 3/1996 | B41J/2/24 |
| JP | 10-337862 | 6/1997 | B41J/2/01 |

* cited by examiner

*Primary Examiner*—John Barlow
*Assistant Examiner*—Blaise Mouttet
(74) *Attorney, Agent, or Firm*—Shoemaker and Mattare

(57) ABSTRACT

A print head transport mechanism of a postage meter for printing postal indicia which are of greater height than a printing height of a print head comprises a carriage to traverse the print head over a band of a print receiving area. The print head is mounted in a sub-carriage mounted on the carriage and the sub-carriage is displaceable in the direction of printing height of the print head. A cam connected between the sub-carriage and the carriage is operable to displace the sub-carriage. The cam is provided with friction surfaces that engage with friction pads during traverse of the carriage to operate the cam and thereby displace the sub-carriage so that printing is effected in a first band during traverse of the print head in one direction and printing is effected in an adjacent band during traverse of the print head in a second direction opposite to said first direction.

21 Claims, 3 Drawing Sheets

PRINT HEAD TRANSPORT MECHANISM

BACKGROUND OF THE INVENTION

This invention relates to transport mechanisms for moving a print head relative to a print receiving medium.

Print head transport mechanisms are known in which a digital print head is traversed alternately in opposite directions across the width of a print receiving medium. Such mechanisms are used in computer output printers in which a plurality of lines of printing are effected on a sheet of paper. After a traverse of the print head across the print receiving medium in which a line of printing is effected, the print receiving medium is fed, in a direction perpendicular to the traverse of the print head, so as to move the line of printing away from alignment with the line of traverse of the print head and to bring an unprinted portion of the print receiving medium into alignment with the traverse of the print head. The print heads may be impact wire dot print heads, ink jet print heads, thermal print heads or other types of print head in which a plurality of print elements are selectively actuated to effect printing. The wires of the impact wire dot print heads are aligned in a row and likewise the ink jet print heads include a plurality of ink jet nozzles aligned in a row and the thermal print heads include a plurality of thermal printing elements aligned in a row. Selective actuation of the wires, nozzles or thermal elements respectively enables printing of dots of ink at selected positions aligned with the row of print elements. The traverse of the print head is perpendicular to the row of printing elements and hence, as is well known, selective actuation of the print elements during traverse of the print head is effective to print desired characters and patterns on the print receiving medium. It will be appreciated that the maximum height of character that can be printed in a traverse of the print head is determined by the length of the row of print elements.

It is proposed to use ink jet print heads for printing postage indicia on mail items. However the required height of the postage indicia is greater than the length of the row of ink jet nozzles in commonly commercially available ink jet print heads.

SUMMARY OF THE INVENTION

According to the invention a print head transport includes a carriage mounted for traversal in a first direction over and beyond a print receiving area; means for driving the carriage in said first direction; a sub-carriage for carrying a print head, said sub-carriage being mounted on said carriage for displacement relative to the carriage in a second direction transverse to said first direction; indexing means connected between the sub-carriage and carriage and operable during traverse of the carriage beyond the print receiving area to displace the sub-carriage relative to the carriage from a first index position to a second index position.

BRIEF DESCRIPTION OF THE DRAWING

An embodiment of the invention will be described hereinafter by way of example with reference to the drawings in which.

DESCRIPTION OF THE PREFERRED EMBODIMENT

Figure 1:
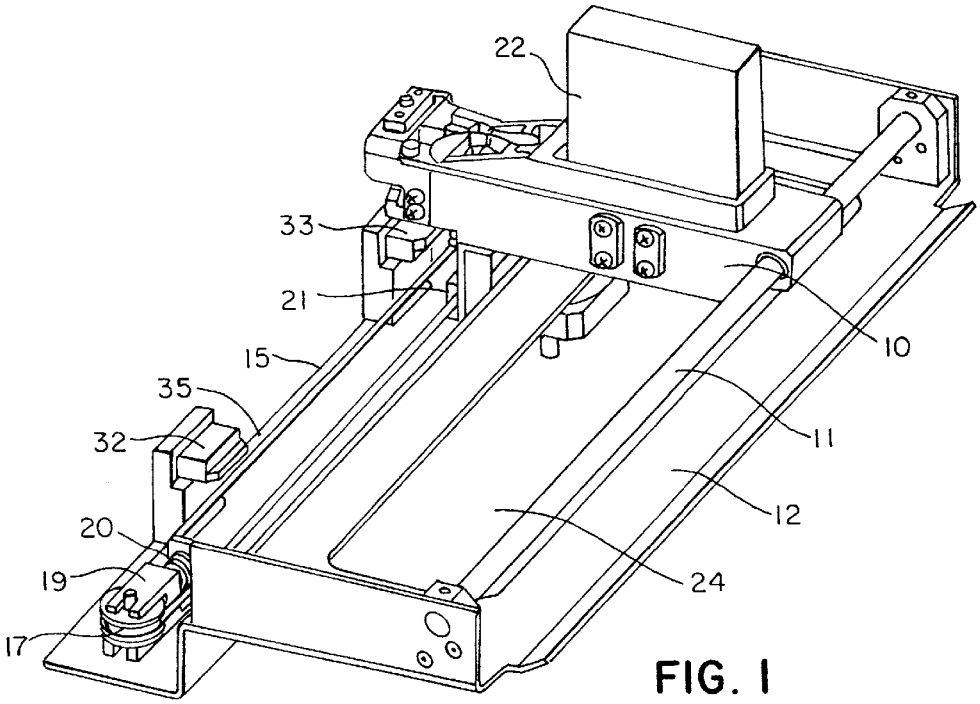
FIG. 1 is an isometric view of a print head transport mechanism.
Figure 2:
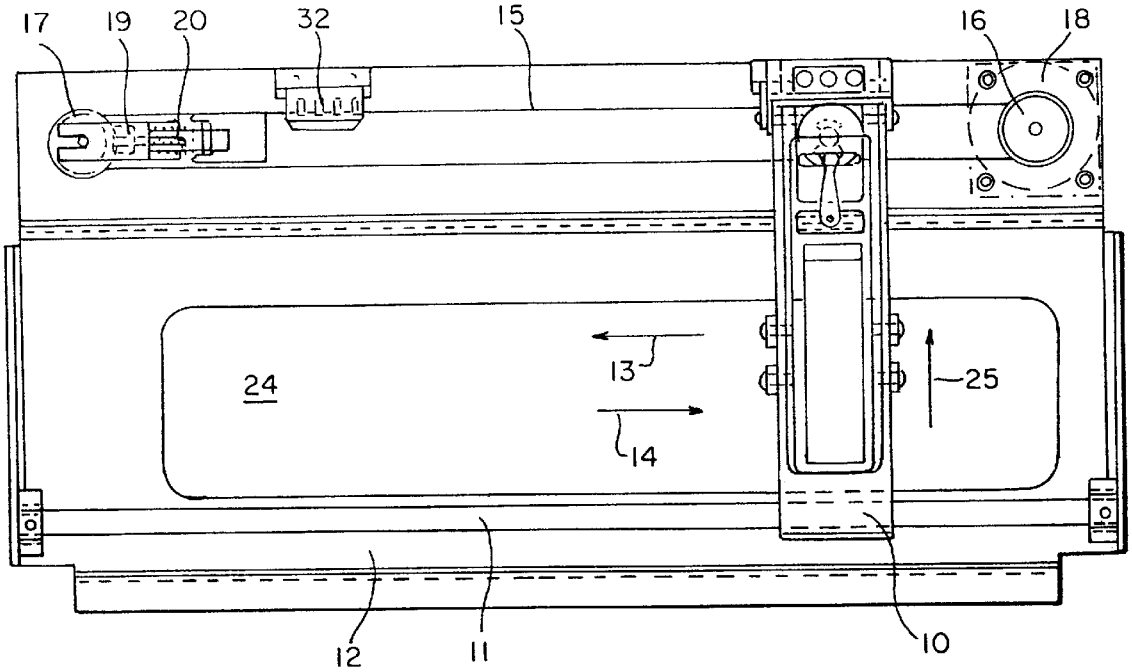
FIG. 2 is a plan view of the mechanism shown in FIG. 1.

Referring first to FIGS. 1 and 2 of the drawings, a carriage 10 is mounted on a guide rod 11 supported on a chassis 12. The carriage 10 is slidingly mounted by means of bearings 27 (see FIG. 3) on the guide rod 11 to permit the carriage to traverse lengthwise along the guide rod in the directions indicated by arrows 13, 14. The carriage is also supported resiliently by a support element 36 (see FIG. 4) resiliently mounted on the carriage and engaging with a bar (not shown) extending parallel to the guide rod 11. A belt 15 passes around a drive pulley 16 and a tension pulley 17 mounted on the chassis 12. The drive pulley 16 is secured to a shaft of a drive motor 18. The tension pulley 17 is mounted in a slidable mounting 19 and a spring 20 acts on the mounting 19 to maintain the belt in a tensioned state. The carriage is secured to the belt at 21. When the drive motor is powered to rotate clockwise as seen in FIG. 2, the carriage is traversed in the direction of arrow 13. Similarly when the drive motor is powered to rotate anti-clockwise as seen in FIG. 2 the carriage is traversed in the direction of arrow 14.

Figure 4:
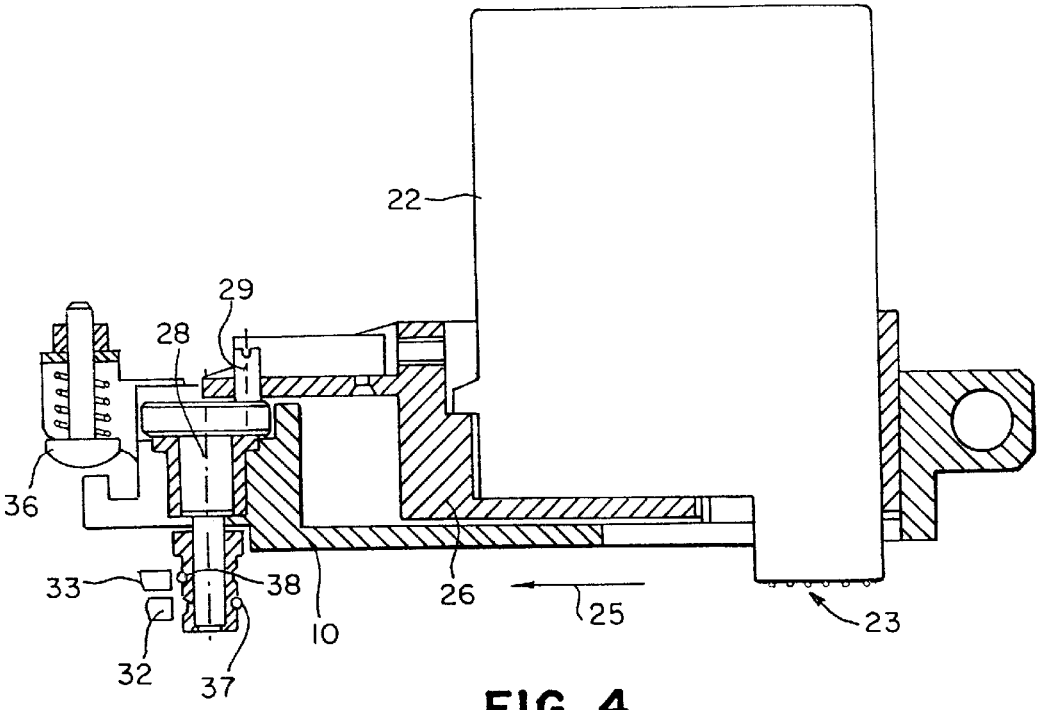
FIG. 4 is a sectional view on line 4—4 of the carriage shown in FIG. 3.
Figure 5:
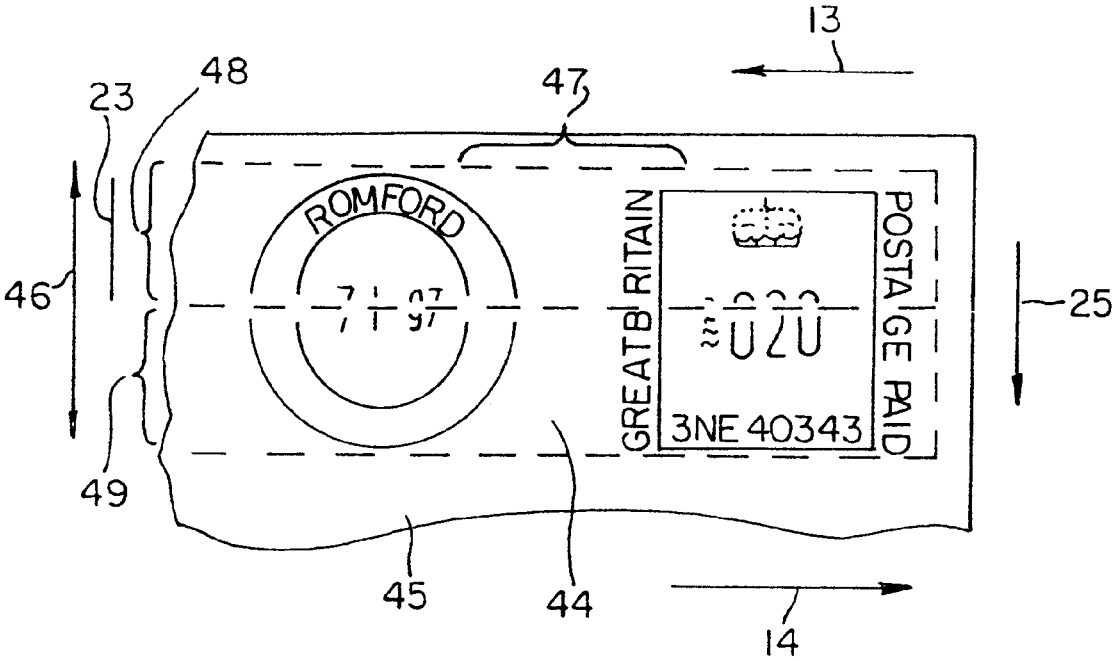
FIG. 5 illustrates printing of a postal indicium in two traverses of the print head.

An ink jet print head 22 is releasably mounted in the carriage. The print head 22 includes a line of ink jet nozzles indicated at 23 (FIG. 4). The ink jet nozzles are directed to eject droplets of ink through an aperture 24 in the chassis 12 toward a mail item (not shown) located below, as seen in FIG. 1, the chassis. The line of ink jet nozzles extends transversely to the direction of traverse of the carriage 10 and hence during traverse of the carriage the ink jet nozzles are traversed over a strip of the mail item. Referring now to FIG. 5, the required height dimension 46 of a postal indicium 47 to be printed on a mail piece 45 by the print head 22 is greater than the length of the line of ink jet nozzles 23. Accordingly the postal indicium is printed during two traverses of the print head. In a first traverse of the print head, for example in the direction of arrow 13, the line of ink jet nozzles are aligned with and traverse a first strip 48 of the print receiving area 44 in which the indicium is to be printed and then prior to a second traverse of the print head in the opposite direction, the print head is displaced in a direction, orthogonal to the traversing of the carriage 10 in the direction of arrows 13, 14, indicated by arrow 25 to align the ink jet nozzles with a second immediately adjacent strip 49 of the print receiving area 44 in which the indicium 47 is to be printed. Thus during the first traverse of the print head a first band of the indicium is printed and in the second traverse of the print head a second band, immediately adjacent the first band, of the indicium is printed. It is to be understood that the postal indicium illustrated in FIG. 5 is a postal indicium currently in use in the United Kingdom and is shown merely by way of example and that the printing apparatus may be used to print other desired forms of postal indicia.

Figure 3:
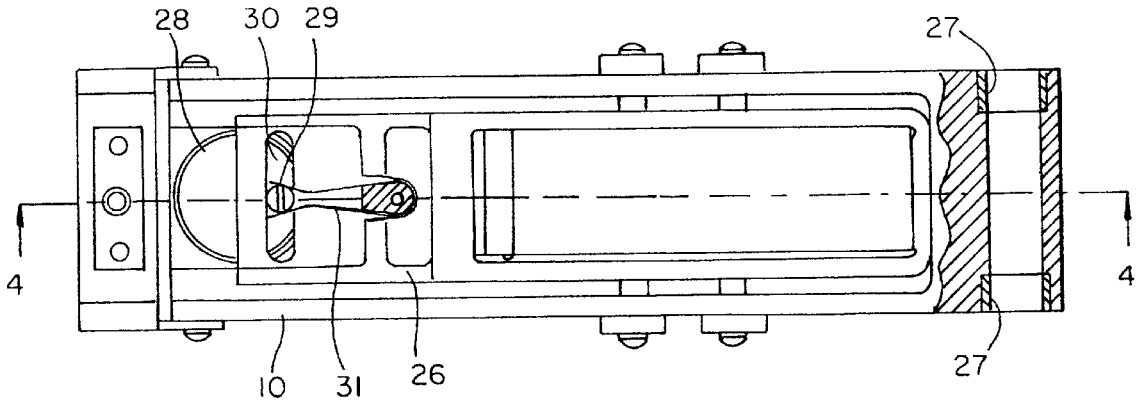
FIG. 3 is a plan view of a carriage of the transport mechanism.

A mechanism for indexing the print head as referred to hereinbefore will now be described. Referring specifically to FIGS. 3 and 4, the carriage 10 carries a sub-carriage 26 which is slidably mounted on the carriage to permit indexing traversal of the sub-carriage relative to the carriage 10 in the direction of arrow 25.

Traversal of the sub-carriage is effected by means of a pin 29 mounted eccentrically on a rotatable element 28 mounted for rotation on the carriage 10, The pin 29 engages in a slot 30 in the sub-carriage 26. With the rotatable element and pin in the position as shown in FIGS. 3 and 4 the sub-carriage is located in a first index position as shown in FIGS. 3 and 4. Rotation of the rotatable element 28 from the position shown, will result in the sub-carriage being moved in the direction of arrow 25 from the first index position until the rotatable element has been rotated through 180°. With the rotatable element rotated through 180° the sub-carriage is located in a second index position. Reverse rotation of the rotatable element 28 through 180° returns the sub-carriage to the first index position. Two ends of a bifurcated spring 31 secured to the sub-carriage 26 act on the pin 29 to urge the rotatable element 28 into 0° and 180° positions thereby maintaining the sub-carriage in either of the two index positions, the first index position as shown in FIGS. 3 and 4 and the second index position in which the sub-carriage is located at a position to the left (as seen in FIG. 4) of the first index position.

The rotatable element 28 includes first and second frictional rings 37, 38. The frictional rings have outer peripheral surfaces that are eccentric relative to the axis of rotation of the rotatable element 28. The rings may be mounted on the element 28 eccentrically or the rings may be of non-uniform cross section. The eccentricity of the peripheral surfaces of the two rings 37, 38 are offset 180° relative to one another. Rotation of the rotatable element 28 is effected by means of first and second friction pads 32, 33. The friction pads 32, 33 are mounted on the chassis 12 at locations beyond the area in which printing is to be effected and each pad includes a planar surface 35 extending parallel to the direction, 14, 15, of traverse of the carriage 10. The pads 32, 33 are mounted such that the surfaces 35 thereof are at different heights relative to the carriage 10 so that one pad 32 is operative to engage with the friction ring 37 and the other pad 33 is operative to engage with the other friction ring 38. During traverse of the carriage beyond the printing area in the direction of arrow 13 the ring 37 is frictionally engaged by the surface 35 of the pad 32 and this causes the ring 37 to roll in frictional engagement with the planar surface 35 of the pad 32. As a result of this rolling of the ring 37 on the surface 35, the rotatable element is rotated. The eccentric form of the peripheral surface of the ring 37 is such that the element 38 is rotated through approximately 180°. The bifurcated spring 31 acting on the pin 29 then ensures that the element 28 is in the 0°, or the 180°, rotational position and hence that the sub-carriage is located in one of the first and second index positions. When the element 28 has been rotated through 180°, the eccentricity of the peripheral surface of the ring 37 ensures that the ring is no longer engaged by the pad 32. Accordingly when motion of the carriage 10 is reversed so as to traverse the printing area the ring 37 is not engaged by the pad 32.

Similarly when the carriage moves beyond the printing area in the direction of arrow 14, the ring 38 is frictionally engaged by the surface 35 of the pad 33 and results in rotation of the element 28 in an opposite direction through 180° thereby returning the sub-carriage and print head to the other of the two index positions.

Thus in operation of the print head to print a postage indicium, with the sub-carriage located in a first index position, the carriage is traversed in a first direction for example in the direction of arrow 13 and the ink jet nozzles are operated selectively to print a first band of the postage indicium. At a position of the carriage beyond the printing area the element 28 comes into engagement with the friction pad 32 which causes rotation of the element 28 through 180° and indexing of the sub-carriage to a second index position. The traverse of the carriage is then reversed, by reversal of the drive motor 18, and during traverse of the printing area the ink jet nozzles are again selectively operated to print a second band of the postage indicium immediately adjoining the first band.

The print head transport mechanism has been described hereinbefore for traversing and indexing an ink jet print head relative to an area of a mail item to receive an imprint of a postage indicia. It is to be understood that the transport mechanism may also be used for similarly traversing and indexing other forms of print head where the impression required to be printed is of greater width than the span of the printing elements of the print head. For example the transport mechanism may be used for traversing and indexing wire dot impact, thermal, magnetic and other types of print head. The print head may be utilised for printing a composite pattern, for example a postage indicium in two traverses or may be used for printing other imprints which have a dimension greater than the span of the print head elements.

The indexing of the print head may be of an extent approximately equal to the span of the printing elements of the print head whereby an impression having a width equal to twice the span of the printing elements may be printed. Alternatively if the width of the required impression is less than twice the span of the printing elements the print head may be indexed to a lesser extent such that the strips of the printing area traversed by the printing elements overlap. Preferably those ones of the printing elements that traverse the region of the overlap are operated in such a manner that there is no overlap in the printing that is effected by the printing elements.

We claim:

1. A print head transport mechanism, including:

a carriage mounted for traversal in a first direction over and beyond a print-receiving area;

a drive unit for driving the carriage in the first direction;

a sub-carriage for carrying a print head having a span of printing elements, the sub-carriage being mounted on the carriage for displacement relative to the carriage in a second direction transverse to the first direction between first and second index positions, thereby providing for the printing of an imprint having a height substantially greater than the span of printing elements; and an indexing member connected between the sub-carriage and the carriage and operable during traverse of the carriage beyond the print-receiving area to displace the sub-carriage relative to the carriage between the first and second index positions.

2. A print head transport mechanism as claimed in claim 1, further including:

a first operator member located to be engaged by the indexing member during traverse of the carriage in a first region beyond the print-receiving area and thereby operate the indexing member to displace the sub-carriage relative to the carriage from the first index position to the second index position.

3. A print head transport mechanism as claimed in claim 2, further including:

a second operator member located to be engaged by the indexing member during traverse of the carriage in a second region beyond the print-receiving area and thereby operate the indexing member to displace the sub-carriage relative to the carriage from the second index position to the first index position, the print-receiving area being located intermediate the first and second regions.

4. A print head transport mechanism as claimed in claim 3, wherein the indexing member includes a rotatable element which is rotated through a determined angle in a first sense by engagement with the first operator member and through the determined angle in a second sense, opposite to the first sense, by engagement with the second operator member.

5. A print head transport mechanism as claimed in claim 4, wherein the determined angle is approximately 180°.

6. A print head transport mechanism as claimed in claim 4, wherein the first and second operator members each include a friction pad engageable by the rotatable element.

7. A print head transport mechanism as claimed in claim 6, wherein the rotatable element includes a first surface engageable with the friction pad of the first operator member when the sub-carriage is in the first index position and the carriage is moved to the first region, and a second surface engageable with the friction pad of the second operator member when the sub-carriage is in the second index position and the carriage is moved to the second region.

8. A print head transport mechanism as claimed in claim 7, wherein the rotatable element is rotatable about an axis extending mutually perpendicular to the first and second directions, and the first surface of the rotatable element and the friction pad of the first operator member are offset in an axial direction relative to the second surface of the rotatable element and the friction pad of the second operator member.

9. A print head transport mechanism as claimed in claim 3, wherein the indexing member includes a rotatable element which is rotated approximately through a determined angle in a first sense by engagement with the first operator member and approximately through the determined angle in a second sense, opposite to the first sense, by engagement with the second operator member, and a resilient element acting on the rotatable element and operative to ensure rotation of the rotatable element through the determined angle.

10. A print head transport mechanism as claimed in claim 2, wherein the indexing member includes a rotatable element which is rotated through an angle by engagement with the first operator member.

11. A print head transport mechanism as claimed in claim 1, wherein the indexing member is operable during each traverse of the carriage beyond the print-receiving area to displace the sub-carriage relative to the carriage between the first and second index positions.

12. A print head transport mechanism, including:

a carriage mounted for traversal in a first direction over and beyond a print-receiving area;

a drive unit for driving the carnage in the first direction;

a sub-carriage for carrying a print head having printing elements, the sub-carriage being mounted on the carriage for displacement relative to the carriage in a second direction transverse to the first direction between first and second index positions;

an indexing member connected between the sub-carriage and the carriage and operable during traverse of the carriage beyond the print-receiving area to displace the sub-carriage relative to the carriage between the first and second index positions; and a first operator member located to be engaged by the indexing member during traverse of the carriage in a first region beyond the print-receiving area and thereby operate the indexing member to displace the sub-carriage relative to the carriage from the first index position to the second index position.

13. A print head transport mechanism as claimed in claim 12, her including:

a second operator member located to be engaged by the indexing member during traverse of the carriage in a second region beyond the print-receiving area and thereby operate the indexing member to displace the sub-carriage relative to the carriage from the second index position to the first index position, the print-receiving area being located intermediate the first and second regions.

14. A print head transport mechanism as claimed in claim 13, wherein the indexing member includes a rotatable element which is rotated through a determined angle in a first sense by engagement with the first operator member and through the determined angle in a second sense, opposite to the first sense, by engagement with the second operator member.

15. A print head transport mechanism as claimed in claim 14, wherein the determined angle is approximately 180°.

16. A print head transport mechanism as claimed in claim 14, wherein the first and second operator members each include a friction pad engageable by the rotatable element.

17. A print head transport mechanism as claimed in claim 16, wherein the rotatable element includes a first surface engageable with the friction pad of the first operator member when the sub-carriage is in the first index position and the carriage is moved to the first region, and a second surface engageable with the friction pad of the second operator member when the sub-carriage is in the second index position and the carriage is moved to the second region.

18. A print head transport mechanism as claimed in claim 17, wherein the rotatable element is rotatable about an axis extending mutually perpendicular to the first and second directions, and the first surface of the rotatable element and the friction pad of the first operator member are offset in an axial direction relative to the second surface of the rotatable element and the friction pad of the second operator member.

19. A print head transport mechanism as claimed in claim 13, wherein the indexing member includes a rotatable element which is rotated approximately through a determined angle in a first sense by engagement with the first operator member and approximately through the determined angle in a second sense, opposite to the first sense, by engagement with the second operator member, and a resilient element acting on the rotatable element and operative to ensure rotation of the rotatable element through the determined angle.

20. A print head transport mechanism as claimed in claim 12, wherein the indexing member includes a rotatable element which is rotated through an angle by engagement with the first operator member.

21. A print head transport mechanism as claimed in claim 12, wherein the indexing member is operable during each traverse of the carriage beyond the print-receiving area to displace the sub-carriage relative to the carriage between the first and second index positions.

* * * * *